US008434245B2

(12) United States Patent
Bell et al.

(10) Patent No.: US 8,434,245 B2
(45) Date of Patent: May 7, 2013

(54) ARTICLE OF FOOTWEAR WITH INTEGRAL UPPER AND SOLE

(75) Inventors: Thomas G. Bell, Portland, OR (US); Michael R. Friton, Portland, OR (US)

(73) Assignee: Nike, Inc., Beaverton, OR (US)

( * ) Notice: Subject to any disclaimer, the term of this patent is extended or adjusted under 35 U.S.C. 154(b) by 583 days.

(21) Appl. No.: 12/615,111

(22) Filed: Nov. 9, 2009

(65) Prior Publication Data

US 2011/0107620 A1 May 12, 2011

(51) Int. Cl.
*A43B 23/00* (2006.01)

(52) U.S. Cl.
USPC ..... 36/48; 36/105

(58) Field of Classification Search ..... 36/48, 105, 36/9 R, 10, 47, 49
See application file for complete search history.

(56) References Cited

U.S. PATENT DOCUMENTS

| | | | | | |
|---|---|---|---|---|---|
| 336,913 | A | * | 3/1886 | Graff | 36/11 |
| 1,359,377 | A | * | 11/1920 | Hollenbeck | 36/11 |
| 2,119,233 | A | | 5/1938 | Judkins | |
| 2,200,080 | A | | 5/1940 | Fein | |
| 2,220,534 | A | | 11/1940 | McLean | |
| 2,340,578 | A | * | 2/1944 | Cairns | 36/9 R |
| 2,384,927 | A | * | 9/1945 | Julianelli | 36/11 |
| 2,444,822 | A | | 7/1948 | Griffin | |
| 2,494,617 | A | * | 1/1950 | Hogan | 36/11 |
| 2,513,005 | A | | 6/1950 | Crawford | |
| 2,548,961 | A | * | 4/1951 | Foster | 36/11 |
| 2,551,723 | A | | 5/1951 | Camero | |
| 2,552,943 | A | | 5/1951 | Danielius | |
| 2,682,713 | A | | 7/1954 | Eiger | |
| 2,748,501 | A | * | 6/1956 | Martin et al. | 36/11 |
| 2,974,427 | A | * | 3/1961 | Wolff | 36/11 |
| 3,002,297 | A | | 10/1961 | Neilson | |
| 3,378,940 | A | * | 4/1968 | Potvin, Jr. | 36/11 |
| 3,538,628 | A | | 11/1970 | Einstein, Jr. | |
| 3,603,006 | A | | 9/1971 | Davenport et al. | |
| 3,762,075 | A | * | 10/1973 | Munschy | 36/97 |
| 3,775,873 | A | | 12/1973 | Small | |
| 3,845,576 | A | | 11/1974 | Howland, Jr. | |
| 3,871,116 | A | | 3/1975 | Vanderlinden | |
| 4,107,857 | A | | 8/1978 | Devlin | |
| 4,150,498 | A | | 4/1979 | Palmer | |

(Continued)

FOREIGN PATENT DOCUMENTS

| | | | |
|---|---|---|---|
| FR | 2634630 | | 2/1990 |
| FR | 2695808 | A1 * | 3/1994 |
| FR | 2744342 | | 8/1997 |
| WO | WO88/09631 | | 12/1988 |

OTHER PUBLICATIONS

Invitation to Pay Additional Fees and, Where Applicable, Protest Fee (with Search Report) mailed Apr. 1, 2011 in International Application No. PCT/US2010/055277.

(Continued)

*Primary Examiner* — Ted Kavanaugh
(74) *Attorney, Agent, or Firm* — Plumsea Law Group, LLC

(57) ABSTRACT

An article of footwear with an integral upper and sole and a method of assembling the article of footwear are disclosed. The method includes folding the article of footwear from a flat configuration and attaching top and bottom lateral edges to form the article of footwear. A kit of parts containing an article of footwear with an integral upper and sole and a set of instructions is also disclosed.

16 Claims, 16 Drawing Sheets

U.S. PATENT DOCUMENTS

| | | | |
|---|---|---|---|
| 4,300,294 | A | 11/1981 | Riecken |
| 4,393,605 | A | 7/1983 | Spreng |
| 4,592,152 | A | 6/1986 | Wright et al. |
| 4,713,895 | A | 12/1987 | Vallieres |
| 4,751,784 | A | 6/1988 | Petker et al. |
| 4,896,439 | A | 1/1990 | Morgan |
| 4,972,609 | A | 11/1990 | Oh et al. |
| 4,976,050 | A | 12/1990 | Houghteling |
| 5,176,624 | A | 1/1993 | Kuehnreich |
| 5,317,822 | A | 6/1994 | Johnson |
| 5,345,638 | A | 9/1994 | Nishida |
| 5,727,334 | A | 3/1998 | Cougar |
| 5,946,737 | A | 9/1999 | Fleege |
| 5,992,058 | A | 11/1999 | Jneid |
| 6,185,845 | B1 | 2/2001 | Gordon |
| 6,874,253 | B2 | 4/2005 | Hollis-Lorent |
| 6,931,766 | B2 | 8/2005 | Greene |
| 7,080,466 | B2 | 7/2006 | Fischbein |
| 7,082,703 | B2 | 8/2006 | Greene et al. |
| 7,210,251 | B1 | 5/2007 | Rolle |
| 7,219,443 | B2 | 5/2007 | Czaplewski et al. |
| 7,237,345 | B2 | 7/2007 | Thomas |
| 7,272,897 | B2 | 9/2007 | Yu |
| 7,464,491 | B2 | 12/2008 | Nakayama |
| 7,549,238 | B2 | 6/2009 | Patakos |
| 7,849,609 | B2 * | 12/2010 | Edington et al. ..... 36/48 |
| 2001/0055684 | A1 | 12/2001 | Davis et al. |
| 2002/0032974 | A1 | 3/2002 | McCrindle |
| 2004/0187346 | A1 | 9/2004 | Bianchi et al. |
| 2004/0216329 | A1 | 11/2004 | Evans |
| 2005/0060907 | A1 | 3/2005 | Hollis-Lorent |
| 2007/0227038 | A1 | 10/2007 | Edington et al. |
| 2007/0251121 | A1 | 11/2007 | Thomas |
| 2008/0209761 | A1 | 9/2008 | Thoraval |
| 2009/0100712 | A1 | 4/2009 | Baker et al. |
| 2009/0119950 | A1 | 5/2009 | Kohatsu et al. |

OTHER PUBLICATIONS

International Preliminary Report on Patentability (including Written Opinion of the ISA) mailed May 24, 2012 in International Application No. PCT/US2010/055277 (13 pages).

International Search Report and Written Opinion mailed Aug. 10, 2011 in International Application No. PCT/US2010/055277.

* cited by examiner

ARTICLE OF FOOTWEAR WITH INTEGRAL UPPER AND SOLE

BACKGROUND

The present invention relates generally to an article of footwear with an integral upper and sole and, in particular, to a method of assembling an article of footwear with an integral upper and sole.

Generally, articles of footwear have been previously disclosed that are manufactured in a one-piece configuration and that can be assembled at home by a customer. Typically, these articles of footwear are formed around a wearer's foot to assemble the article of footwear. Often, these articles of footwear include laces or other tightening mechanisms disposed down the center portion of the article of footwear for securing the article of footwear to the wearer's foot.

Other articles of footwear also have been disclosed that are manufactured in multi-piece configurations and can be assembled at home by a customer. Typically, these articles of footwear require more effort to assemble than those made with a one-piece configuration.

Articles of footwear that have been disclosed are limited in their methods of manufacture and in their ease of assembly.

Therefore, there exists a need in the art for an article of footwear that can be manufactured with an integral upper and sole portion. There is also a need in the art for an article of footwear that can be easily assembled.

SUMMARY

In one aspect, the invention provides an article of footwear comprising: an interior layer, an exterior layer connected to the interior layer, and wherein the interior layer and the exterior layer are cut in a pattern forming an integral upper portion and sole portion.

In another aspect, the invention provides a method of assembling an article of footwear comprising an integral upper portion and sole portion, the method comprising: folding the article of footwear along a midline between the upper portion and the sole portion, and attaching a top lateral edge of the upper portion to a bottom lateral edge of the sole portion.

In another aspect, the invention provides a kit of parts, comprising: an article of footwear cut in a pattern forming an integral upper portion and sole portion, a set of instructions, and wherein a top lateral edge of the upper portion may be attached to a bottom lateral edge of the sole portion to form an assembled article of footwear.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Generally, an article of footwear with an integral upper and sole may be provided in a flat configuration that can be assembled into a finished article of footwear. A method of assembling an article of footwear with an integral upper and sole may be provided using various methods for joining together the article of footwear into a finished article of footwear.

Figure 1:
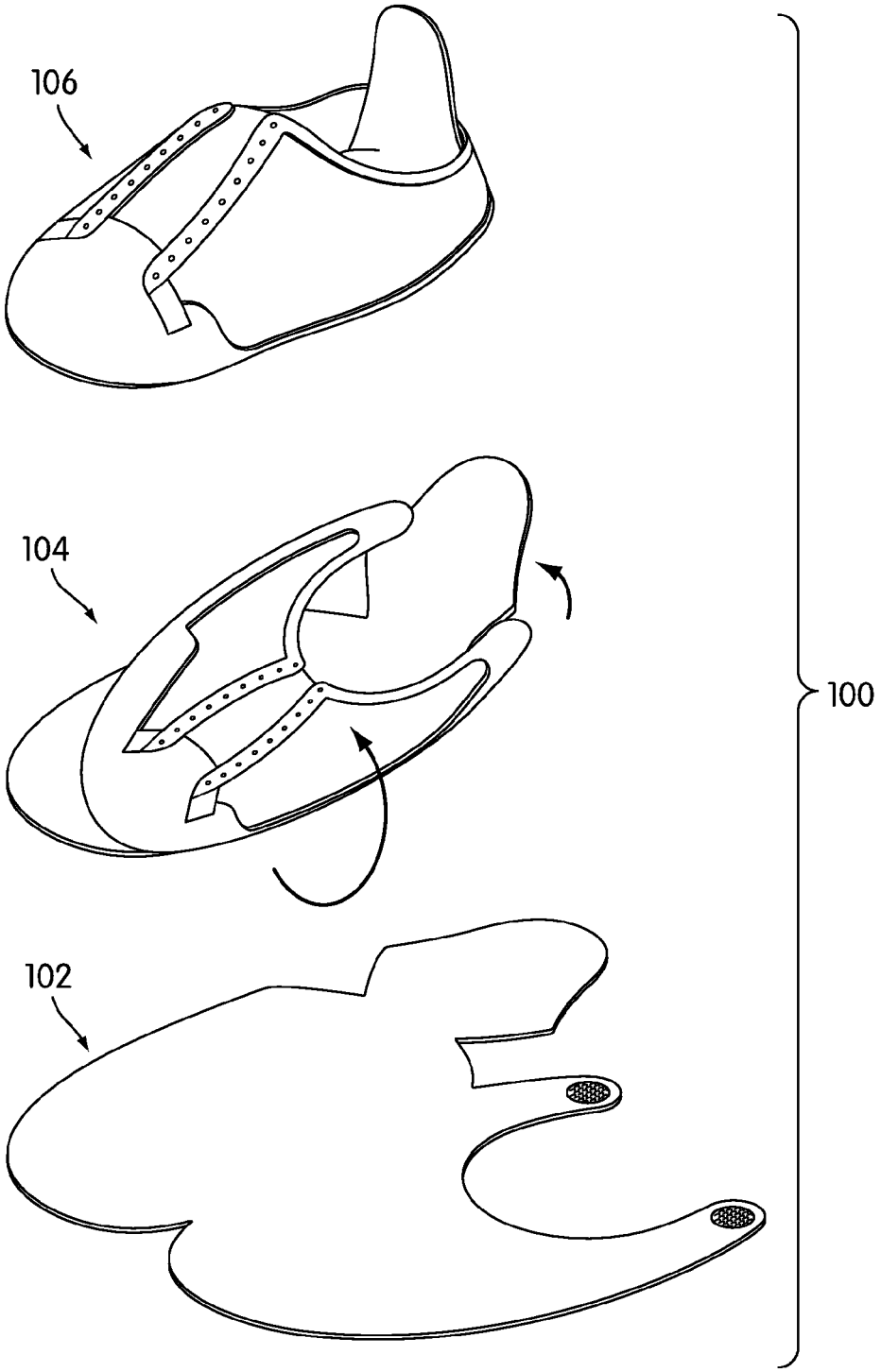
FIG. 1 is an isometric view of an embodiment of an article of footwear with an integral upper and sole in various stages of assembly.

FIG. 1 is an overview of an embodiment of the process 100 for assembling an article of footwear. In one exemplary embodiment, the article of footwear may be assembled by a customer. As shown in FIG. 1, an article of footwear may be provided in a flat configuration in a first step 102. The article of footwear may be folded in a second step 104. The article of footwear may be joined together in a final step 106 to complete the finished article of footwear.

In one exemplary embodiment, article of footwear may be a bootie. In another exemplary embodiment, article of footwear may be a shoe for a baby, child or adult. In other embodiments, article of footwear could be any type of footwear, including, but not limited to: a running shoe, a dance shoe, a basketball shoe, a high heel shoe, a boot, a slip-on shoe, a low top shoe, as well as other types of footwear. In some cases, additional provisions may be made to increase support for the article of footwear.

Additionally, while a single article of footwear is shown in the current embodiments, the same principles taught in this detailed description could be applied to a second, complementary article of footwear.

Figure 2:
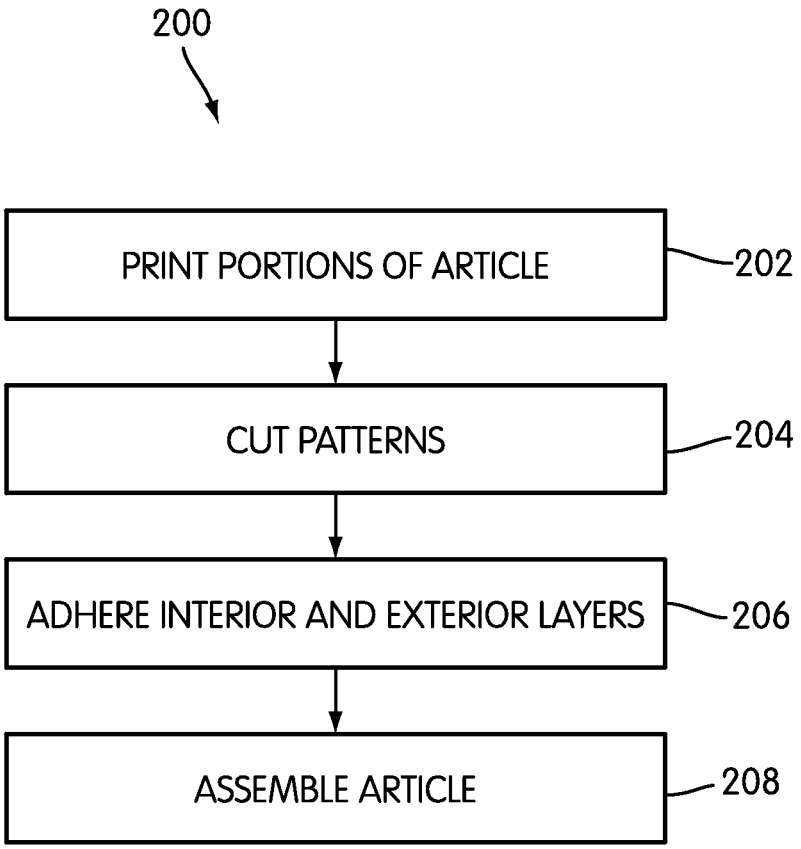
FIG. 2 is a schematic view of an embodiment of a method for assembling an article of footwear with an integral upper and sole.

FIG. 2 illustrates an exemplary process 200 for the manufacture of an article of footwear with an integral upper and sole. The order of the steps illustrated in FIG. 2 is exemplary and not required. As shown in FIG. 2, in a first step 202, portions of an article of footwear may be printed, including an interior layer and an exterior layer. In an exemplary embodiment, the portions may be provided with printed designs. In some embodiments, a customer may custom design portions of the article of footwear, including, but not limited to portions of the interior layer and exterior layer. In some cases, a customer may customize portions of the article of footwear using the system and method disclosed in copending and commonly owned U.S. Pat. No. 7,945,343, entitled "Method of Making an Article of Footwear", and issued on May 17, 2011, which is incorporated herein by reference.

Referring to FIG. 2, at a second step 204, the article of footwear may be cut in a pattern forming an integral upper and sole. In some embodiments, an interior layer and an exterior layer may be cut using a pattern forming an integral upper and sole. In some embodiments, the interior and exterior layers may be cut using reverse patterns such that the interior and exterior layers can be aligned in a back-to-back configuration. In some cases, portions of the article of footwear may be laser cut. In other cases, portions of the article of footwear may be stamped or die-cut. In other cases, portions of the article of footwear may be cut using different methods depending on the material used for the article of footwear.

Referring to FIG. 2, in a third step 206, the interior layer and the exterior layer may be connected. In one embodiment, the interior layer may be provided with an adhesive backing for connecting the exterior and interior layers. In different embodiments, the interior and exterior layers may be connected to one another in various ways, including, but not limited to: adhesive, heat, pressure, stitching and any other method of attachment.

As shown in FIG. 2, in a fourth step 208, the article of footwear may be assembled to form a finished article of footwear. The article of footwear may be assembled by joining the article of footwear as described in more detail below with reference to the exemplary embodiments. In some cases, the article of footwear may be assembled by a customer. In other cases, the article of footwear may be assembled by a retailer or a manufacturer. Generally, a retailer may be anyone configured to make and/or sell articles of footwear. In some cases, a retailer may be associated with a retail store. In other cases, a retailer may be associated with a kiosk in a mall. In still other cases, a retailer may be associated with one or more manufacturing locations.

Figure 3:
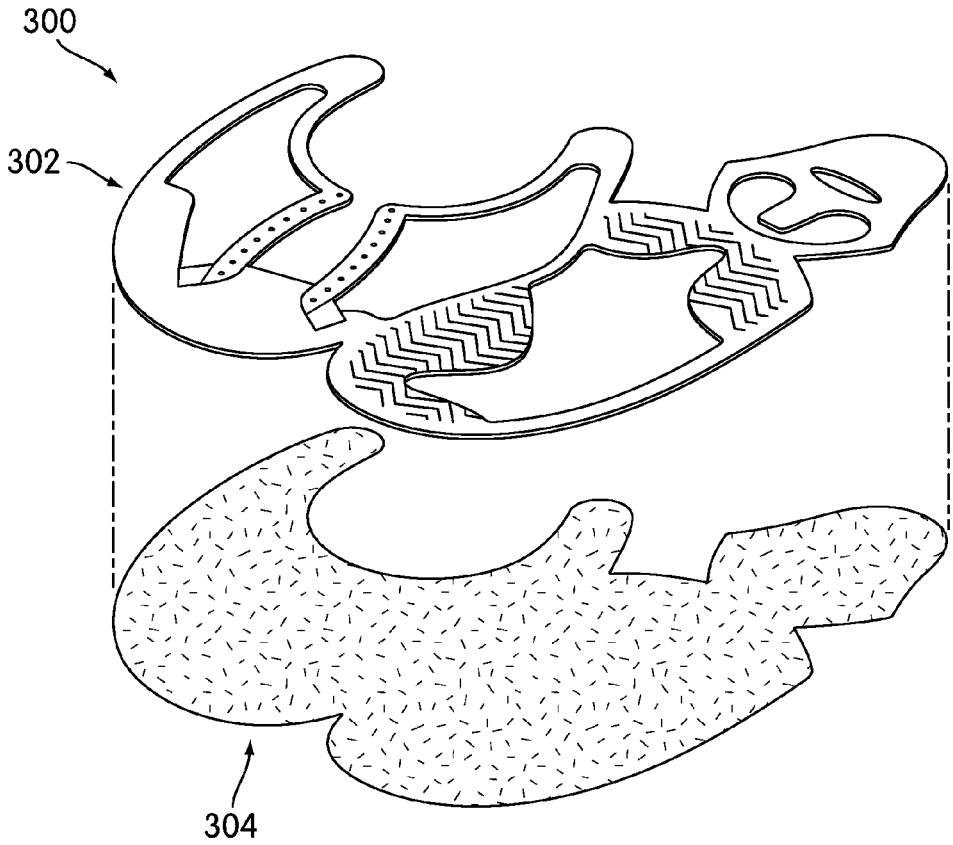
FIG. 3 is an isometric view of an exemplary embodiment of an exterior layer of an article of footwear.

FIG. 3 illustrates an exemplary embodiment of an exterior layer 300 of an article of footwear. In some embodiments, exterior layer 300 may form the outside of an article of footwear. For the purposes of illustration, the exemplary embodiments of the exterior layers and interior layers shown in the figures are shown with printed designs to allow the layers to be clearly distinguished. In other embodiments, the interior and exterior layers may include different designs, including, but not limited to: various patterns, solids, graphics, colors and custom designs. Referring to FIG. 3, in this embodiment, exterior layer 300 includes an outer material 304 and a structural overlay 302. In different embodiments, outer material 304 may be made from different materials, including, but not limited to: fabric, mesh, canvas, leather, rubber, plastic and any other natural or synthetic material.

Referring to FIG. 3, structural overlay 302 may be disposed over outer material 304. In one embodiment, structural overlay 302 may include a ground engaging portion. In some embodiments, structural overlay 302 may reinforce the article of footwear. In other embodiments, structural overlay 302 may form various portions of the article of footwear, including, but not limited to: the toe cap, heel, eyelets and ground engaging portion of the article of footwear. In some embodiments, portions of the structural overlay 302 may be laser cut. In other embodiments, portions of the structural overlay 302 may be customized. In different embodiments, portions of the structural overlay 302 may be made of various materials, including, but not limited to: escane, rubber, polyurethane and other natural and synthetic materials. In some cases, the structural overlay 302 may include more than one material. In some embodiments, portions of the structural overlay 302 may include materials with different levels of durability.

Figure 4:
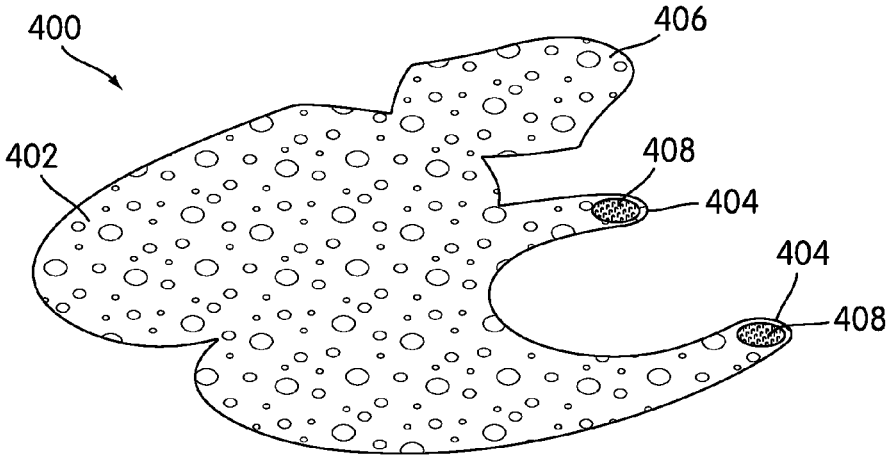
FIG. 4 is an isometric view of an exemplary embodiment of an interior layer of an article of footwear.

FIG. 4 illustrates an exemplary embodiment of an interior layer 400. In some embodiments, interior layer 400 may form the inside of an article of footwear. In this embodiment, interior layer 400 includes an inner material 402. Inner material 402 may be cut in a pattern forming an integral upper and sole that includes a heel portion 406 and heel tabs 404. Heel tabs 404 may include fasteners 408 disposed on inner material 402. In some cases, fasteners 408 may include hook and loop fasteners. In other cases, fasteners 408 may include various attachment mechanisms, including, but not limited to: zippers, buttons, snaps as well as other types of fasteners.

Figure 5:
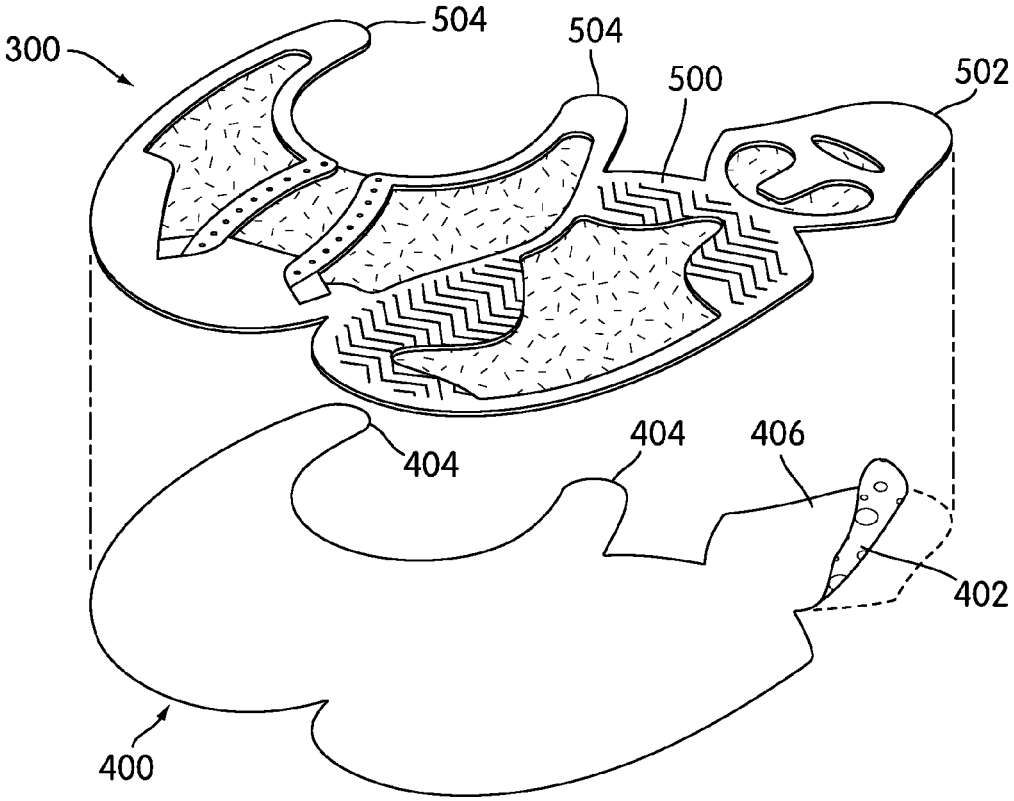
FIG. 5 is an isometric view of an embodiment of an exterior layer of an article of footwear aligned over an interior layer of an article of footwear.
Figure 6:
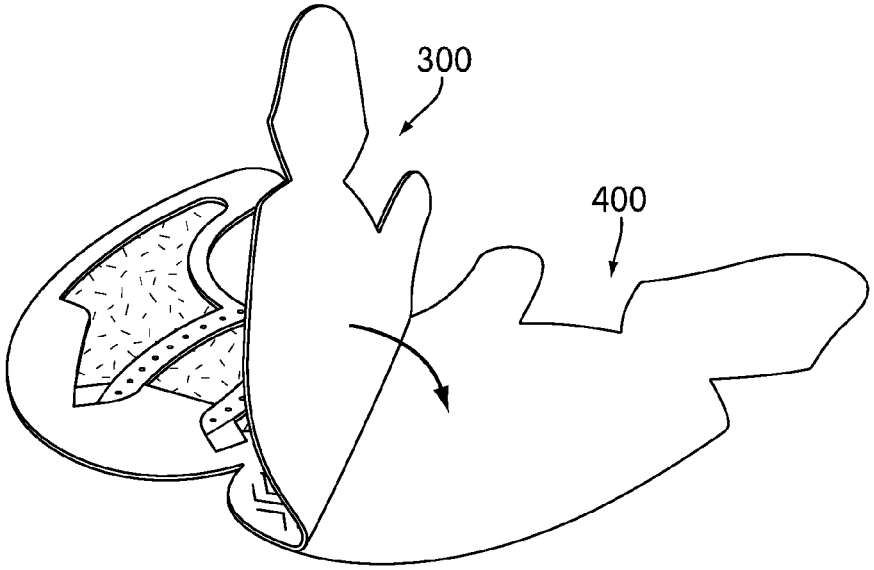
FIG. 6 is an isometric view of an embodiment of an exterior layer and an interior layer of an article of footwear in the process of being attached.
Figure 7:
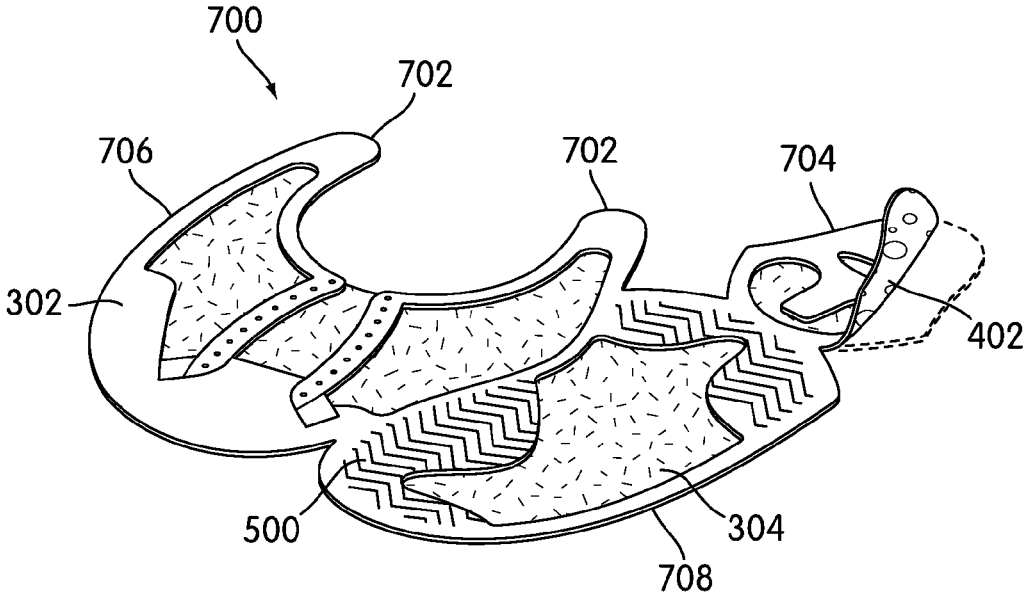
FIG. 7 is an isometric view of an embodiment of an unassembled article of footwear with an integral upper and sole.

FIGS. 5-7 illustrate an exemplary embodiment of the method of connecting the exterior and interior layers to form an article of footwear with an integral upper and sole. Referring to FIG. 5, exterior layer 300 may be connected with interior layer 400. In this embodiment, inner material 402 is configured so that the back of inner material 402 can connect with the back of exterior layer 300. In some embodiments, the back of inner material may include adhesive for connecting the interior layer 400 to the exterior layer 300. As shown in FIG. 5, exterior layer 300 may be aligned with interior layer 400 so that interior heel portion 406 can be aligned with exterior heel portion 502 and heel tabs 404 can be aligned with exterior heel tabs 504. In this embodiment, exterior layer 300 includes a ground engaging portion 500.

FIG. 6 illustrates an exemplary embodiment of exterior layer 300 being connected to interior layer 400. In some embodiments, exterior layer 300 and interior layer 400 may be connected using adhesive. In one exemplary embodiment, heat and pressure may be applied to adhere exterior layer 300 and interior layer 400 together. In different embodiments, exterior layer 300 and interior layer 400 may be connected to one another in various ways, including, but not limited to: adhesive, heat, pressure, stitching and any other method of attachment.

FIG. 7 illustrates an exemplary embodiment of an article of footwear 700 with an integral upper and sole. Referring to FIG. 7, the outside of article of footwear 700 may include structural overlay 302 and outer material 304. The inside of article of footwear 700 may include inner material 402. In some embodiments, article of footwear 700 may include an upper portion with heel tabs 702 and a sole portion with a heel portion 704 and a ground engaging portion 500. In this embodiment, the upper portion includes a top lateral edge 706 and the sole portion includes a bottom lateral edge 708. As more fully explained below, article of footwear 700 may be assembled by joining together top lateral edge 706 and bottom lateral edge 708.

Figure 8:
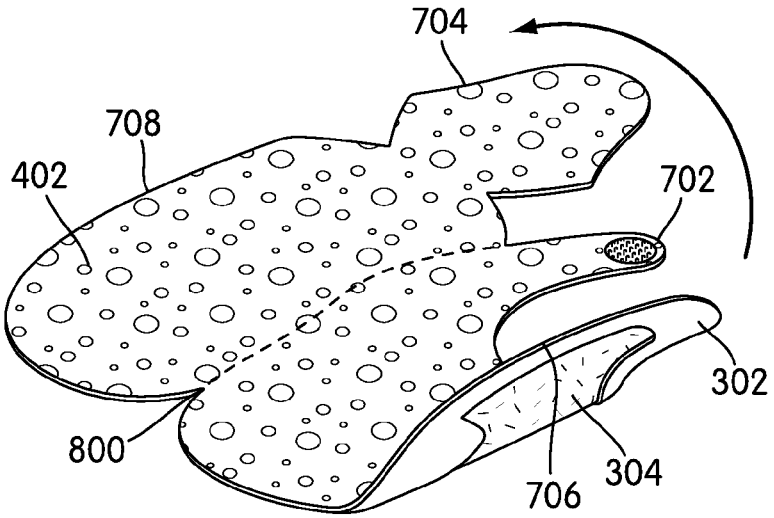
FIG. 8 is an isometric view of an embodiment of a method of assembly for an article of footwear with an integral upper and sole.
Figure 9:
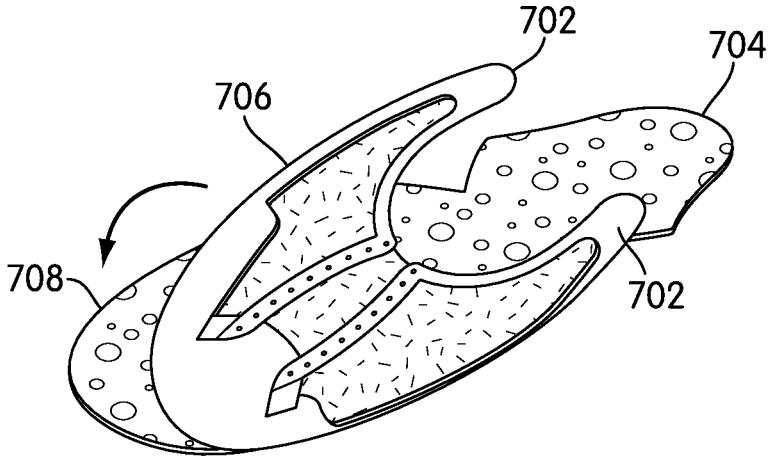
FIG. 9 is an isometric view of an embodiment of an article of footwear with an integral upper and sole in the process of assembly.
Figure 10:
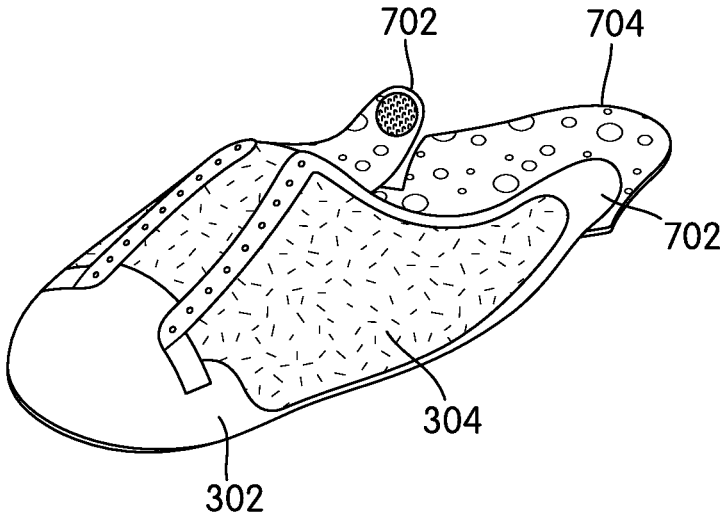
FIG. 10 is an isometric view of an embodiment of an article of footwear with an integral upper and sole that has been folded along a midline.

FIGS. 8-17 illustrate an exemplary embodiment of a method of assembling an article of footwear with an integral upper and sole. FIG. 8 shows an embodiment of an article of footwear in the process of assembly. In this embodiment, a midline 800 divides the upper portion of the article of footwear from the sole portion. Referring to FIG. 8, top lateral edge 706 of the upper portion may be moved towards bottom lateral edge 708 of the sole portion by folding the article of footwear along midline 800. FIG. 9 illustrates an embodiment of the article of footwear in the process of assembly where top lateral edge 706 may be brought in proximity to bottom lateral edge 708. In FIG. 10, the top lateral edge and bottom lateral edge of the article of footwear have been brought together. As shown in FIG. 10, the outer material 304 and structural overlay 302 form the outside of the upper portion of the article of footwear.

Figure 11:
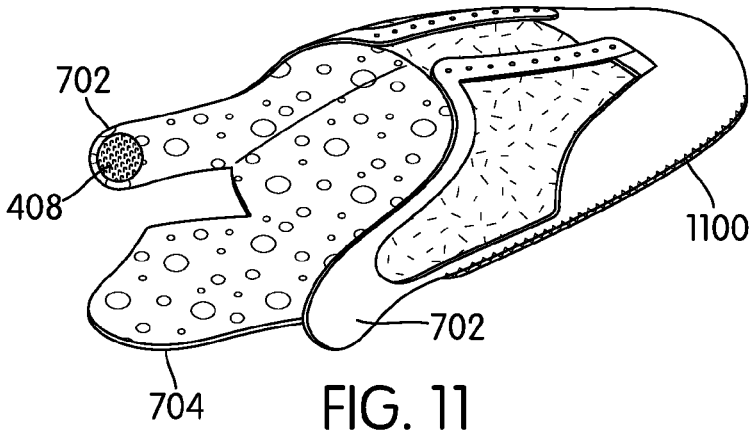
FIG. 11 is an isometric view of an embodiment of an article of footwear with an integral upper and sole that has been attached along a lateral edge.

FIG. 11 illustrates an exemplary embodiment of a method of assembling an article of footwear where the article of footwear has been attached by stitching 1100 along the top lateral edge and bottom lateral edge. Generally, any kind of stitching may be used to accomplish the attachment of the top lateral edge and bottom lateral edge of the article of footwear. In some cases, simple stitches may be used. In other cases, more complex stitches may be used. Examples of various stitches that may be used include, but are not limited to: backstitches, basting stitches, blind stitches, buttonhole stitches, chain stitches, cross-stitches, embroidery stitches, feather stitches, hemming stitches, lock stitches, padding stitches, running stitches, slip stitches, stretch stitches, top stitches, whip stitches, zigzag stitches as well as any other types of machine or manual stitches.

In other embodiments, the top and bottom lateral edges may be provided with pre-configured holes. This alternative arrangement may allow for increased ease of manual stitching, which may appeal to some customers.

Figure 12:
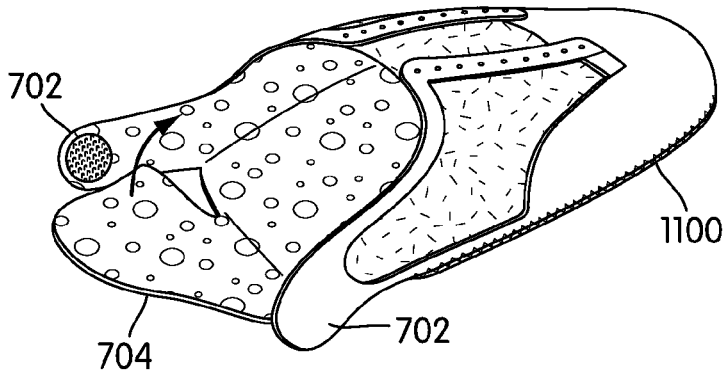
FIG. 12 is an isometric view of an embodiment of an article of footwear with an integral upper and sole in the process of assembly.
Figure 13:
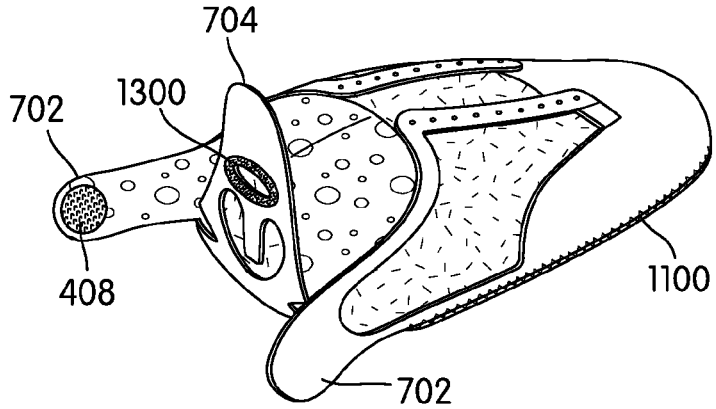
FIG. 13 is an isometric view of an embodiment of an article of footwear with an integral upper and sole with a raised heel portion.

FIGS. 12-17 illustrate an exemplary embodiment of the process for attaching a heel portion of an article of footwear with an integral upper and sole. FIG. 12 illustrates an embodiment of the article of footwear in the process of assembly where a heel portion 704 may be moved towards an upright position. In FIG. 13, the heel portion 704 may be brought to an upright position. In some embodiments, heel portion 704 may include a back plate 1300 for engaging with fasteners 408 to removably attach heel tabs 702.

Figure 14:
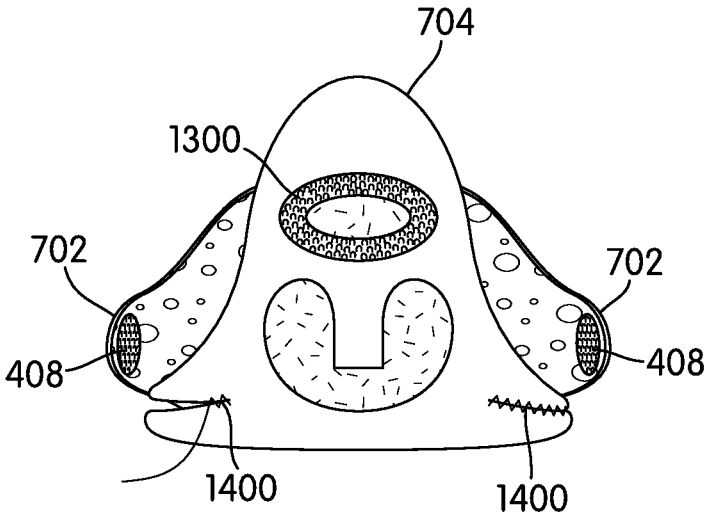
FIG. 14 is an isometric view of a close up of an embodiment of a heel portion that is being attached to a sole.

FIG. 14 illustrates an exemplary embodiment of a method of assembling an article of footwear where the heel portion 704 has been attached to the sole by stitching 1400. Generally, any kind of stitching may be used to accomplish the attachment of the heel portion 704 to the sole. In different embodiments, the stitching 1400 may include various types of stitches disclosed above. In other embodiments, heel portion 704 may be provided with pre-configured holes.

Figure 15:
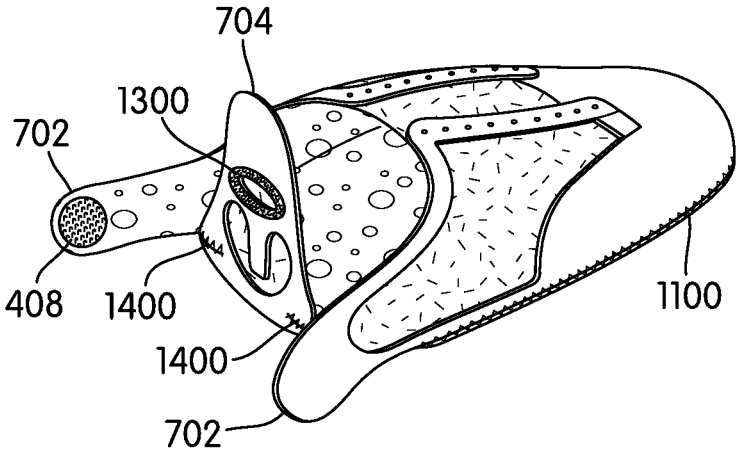
FIG. 15 is an isometric view of an embodiment of an article of footwear with an integral upper and sole with an attached heel portion.
Figure 16:
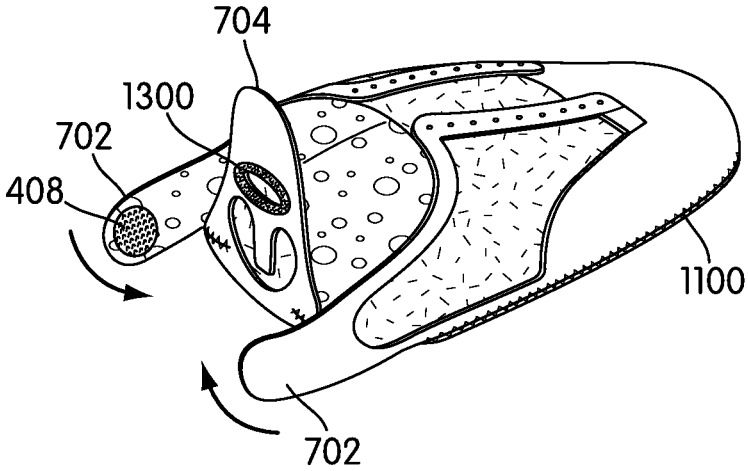
FIG. 16 is an isometric view of an embodiment of an article of footwear with an integral upper and sole in the process of assembly.
Figure 17:
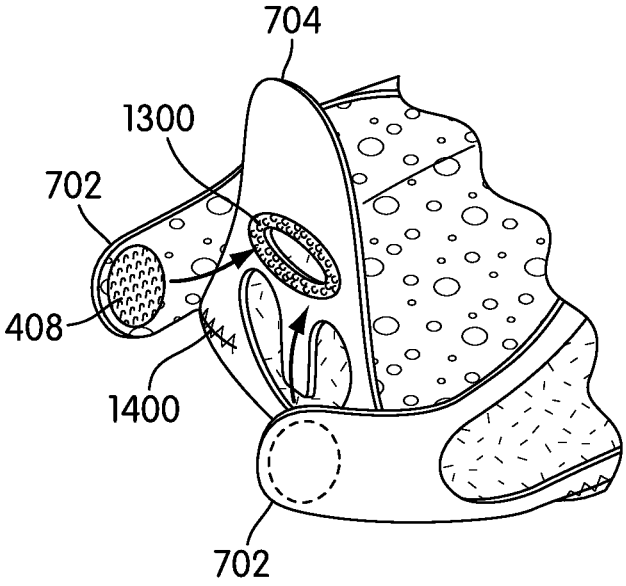
FIG. 17 is an isometric view of a close up of an embodiment of a heel portion of an article of footwear with an integral upper and sole.

As shown in FIG. 15, heel portion 704 has been attached to the sole of the article of footwear using stitching 1400. In this embodiment, stitching 1400 may hold heel portion 704 in an upright position. FIG. 16 illustrates an exemplary embodiment of a process of closing heel tabs 702. In this embodiment, fasteners 408 may be provided on heel tabs 702 for engaging with back plate 1300 to removably attach heel tabs 702. FIG. 17 is a close up view of the embodiment of FIG. 16 showing fasteners 408 in proximity to back plate 1300. In other embodiments, heel tabs 702 may include a buckle.

In some embodiments, heel tabs 702 may fasten the upper portion of the article of footwear from an open position to a closed position around a foot. The term "open position," as used in this detailed description and in the claims, refers to a loosened position of an article of footwear in which a foot may be easily slipped into the article of footwear. The term "closed position," as used in this detailed description and in the claims, refers to a tightened position of an article of footwear in which the article of footwear is tightly wrapped around the foot and cannot be generally removed.

Figure 18:
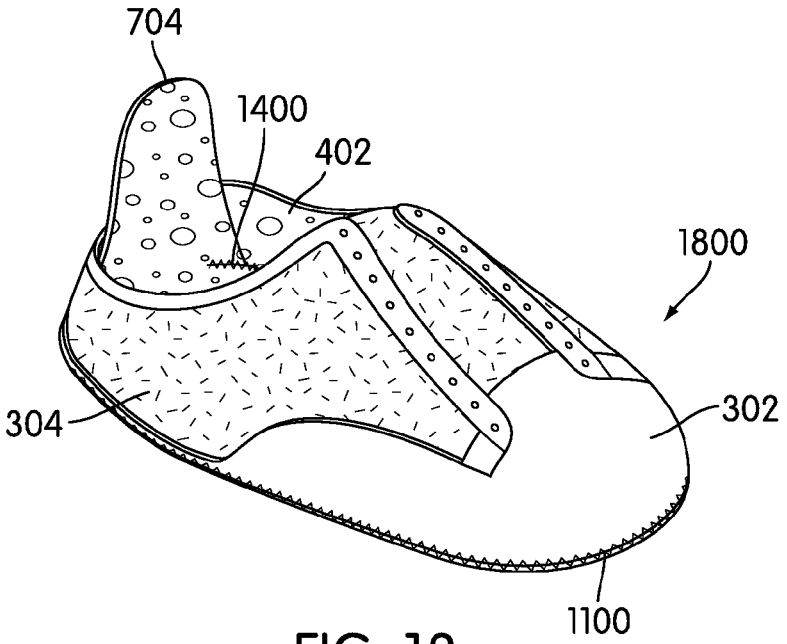
FIG. 18 is an isometric view of an embodiment of an assembled article of footwear with an integral upper and sole.
Figure 19:
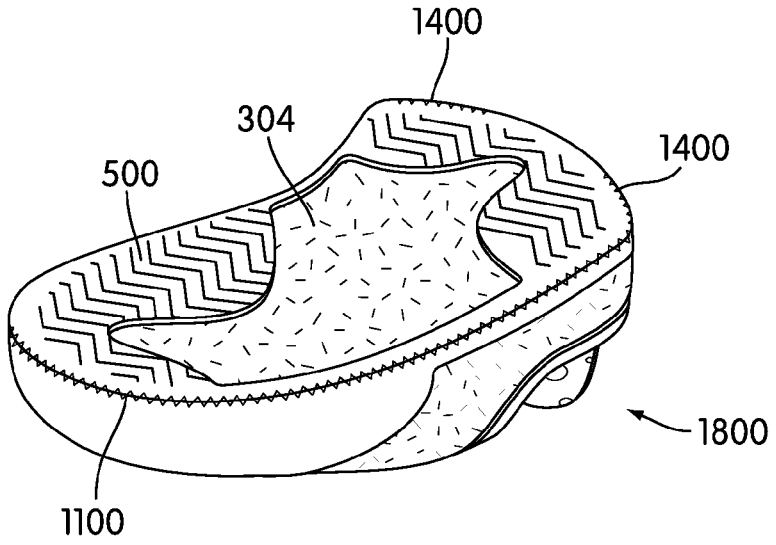
FIG. 19 is an isometric view of an embodiment of the underside of an article of footwear with an integral upper and sole.

FIGS. 18 and 19 illustrate an exemplary embodiment of a finished article of footwear 1800 assembled according to the process described in FIGS. 8-17. Referring to FIG. 18, in this embodiment, finished article of footwear 1800 includes outer material 304 and structural overlay 302 on the outside of article of footwear 1800 and inner material 402 on the inside of article of footwear 1800. In this embodiment, stitching 1100 has been used to attach the top lateral edge and bottom lateral edge of the article of footwear and stitching 1400 has been used to attach heel portion 704 to the sole.

FIG. 19 illustrates the underside of finished article of footwear 1800. In this embodiment, ground engaging portion 500 of the structural overlay is visible. In some embodiments, ground engaging portion 500 may include a traction tread. In different embodiments, the ground engaging portion 500 may be made of various materials, including, but not limited to:

escane, rubber, polyurethane and other natural and synthetic materials. In some embodiments, ground engaging portion 500 may include a material with a different level of durability than the rest of the structural overlay. In some cases, ground engaging portion 500 may include more than one material.

Figure 20:
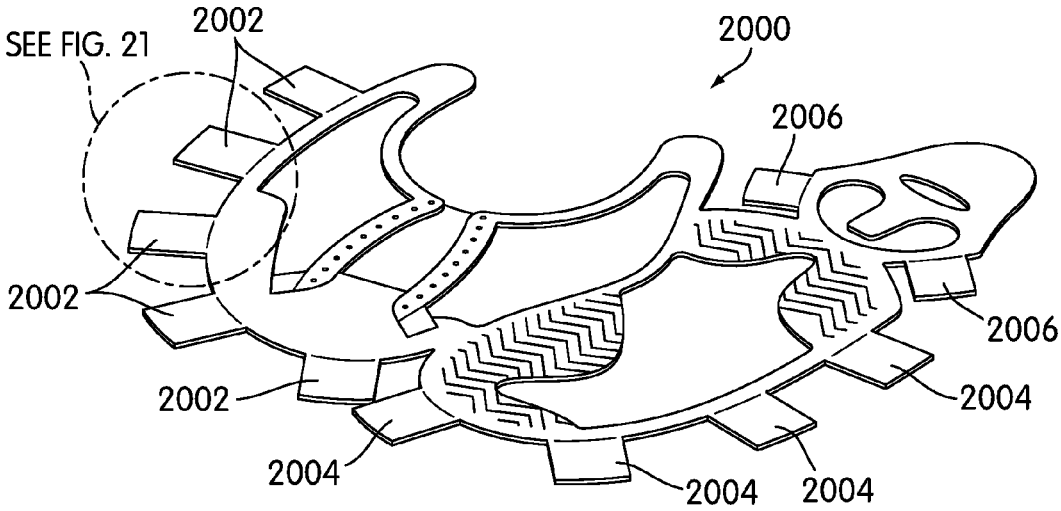
FIG. 20 is an isometric view of an exemplary embodiment of an unassembled article of footwear with an integral upper and sole.

FIGS. 20-29 illustrate different exemplary embodiments of an article of footwear with an integral upper and sole. Referring to FIG. 20, an article of footwear 2000 with an integral upper and sole may be provided with alternating channels. In this embodiment, the alternating channels are shown in an unfinished configuration. Alternating channels may include top lateral edge channels 2002, bottom lateral edge channels 2004 and heel portion channels 2006.

Figure 21:
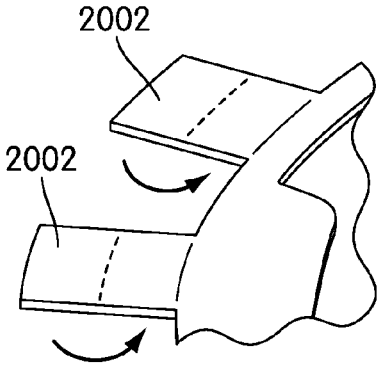
FIG. 21 is an isometric view of a close up of an embodiment of alternating channels on an article of footwear with an integral upper and sole.
Figure 22:
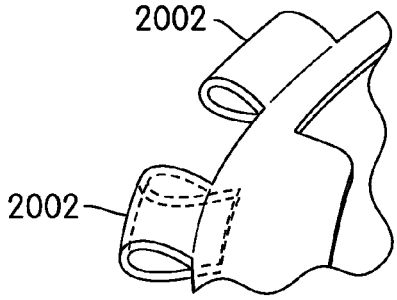
FIG. 22 is an isometric view of a close up of an embodiment of folded over alternating channels on an article of footwear with an integral upper and sole.

FIGS. 21-22 illustrate an exemplary embodiment of a method of forming the top lateral edge channels 2002 of article of footwear 2000. In FIG. 21, the unfinished top lateral edge channels 2002 are shown in the process of being folded over to form the channels. Referring to FIG. 22, top lateral edge channels 2002 may be formed by attaching the ends of the unfinished channels to the back side of the flat article of footwear. In some embodiments, top lateral edge channels 2002 may be attached using adhesive. In other embodiments, top lateral edge channels 2002 may be attached using stitching. In different embodiments, top lateral edge channels 2002 may be attached using any attachment mechanism. The process illustrated in FIGS. 21-22 and described above also may be performed with bottom lateral edge channels 2004 and heel portion channels 2006.

Figure 23:
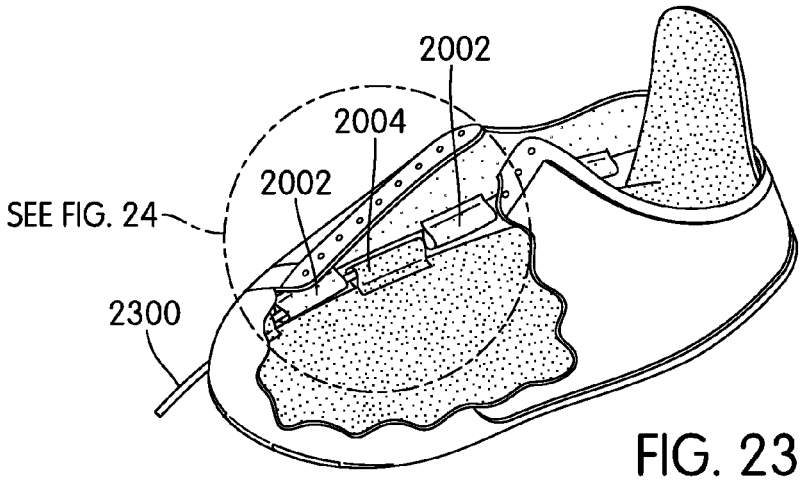
FIG. 23 is an isometric cut away view of an embodiment of alternating channels on an article of footwear with an integral upper and sole.

FIG. 23 illustrates an exemplary embodiment of an article of footwear with alternating channels. Referring to FIG. 23, top lateral edge channels 2002 may be brought together with bottom lateral edge channels 2004 to form alternating channels. In this embodiment, a cord 2300 may be passed through the alternating channels formed by top lateral edge channels 2002 and bottom lateral edge channels 2004.

Figure 24:
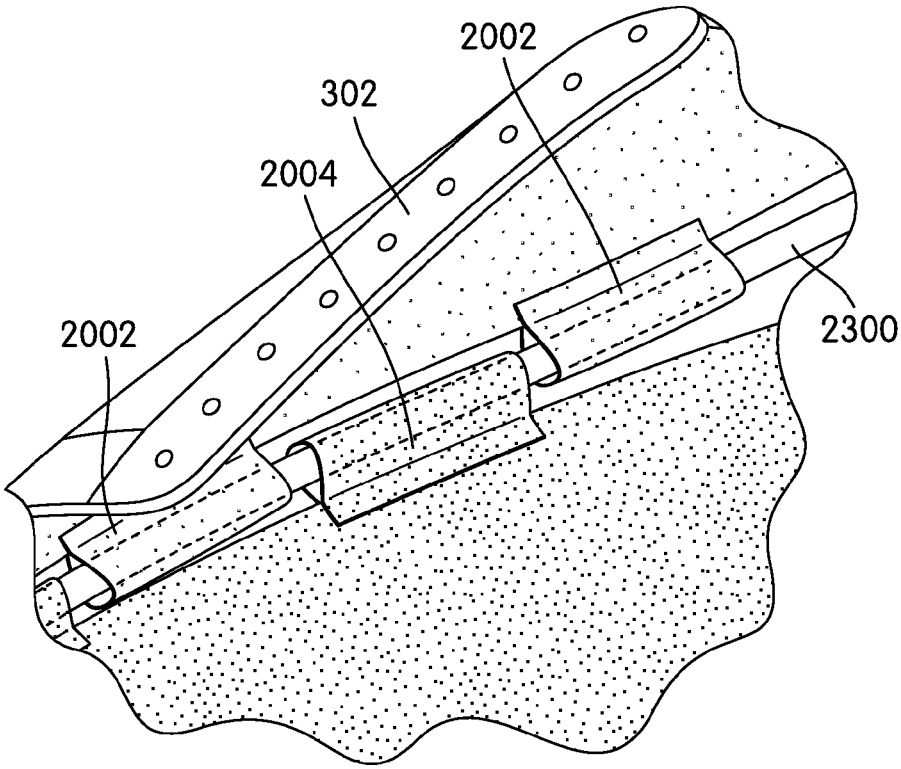
FIG. 24 is an isometric view of a close up of an embodiment of a cord passing through alternating channels on an article of footwear with an integral upper and sole.

FIG. 24 illustrates a close up view of cord 2300 passing through the alternating channels formed by top lateral edge channels 2002 and bottom lateral edge channels 2004. In this embodiment, cord 2300 is used to attach the top lateral edge and the bottom lateral edge to form the article of footwear. In some embodiments, cord 2300 also may be passed through heel portion channels 2006 to attach the heel portion to the sole of the article of footwear.

Figure 25:
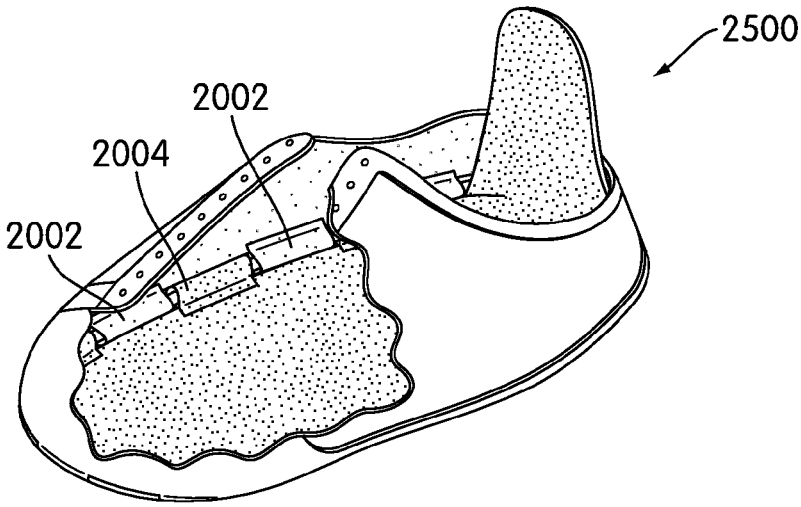
FIG. 25 is an isometric view of an embodiment of a partially attached lateral side of an article of footwear with an integral upper and sole.

FIG. 25 is a cut away view of an exemplary embodiment of an article of footwear 2500 with an integral upper and sole that has been assembled by passing a cord through alternating channels.

Figure 26:
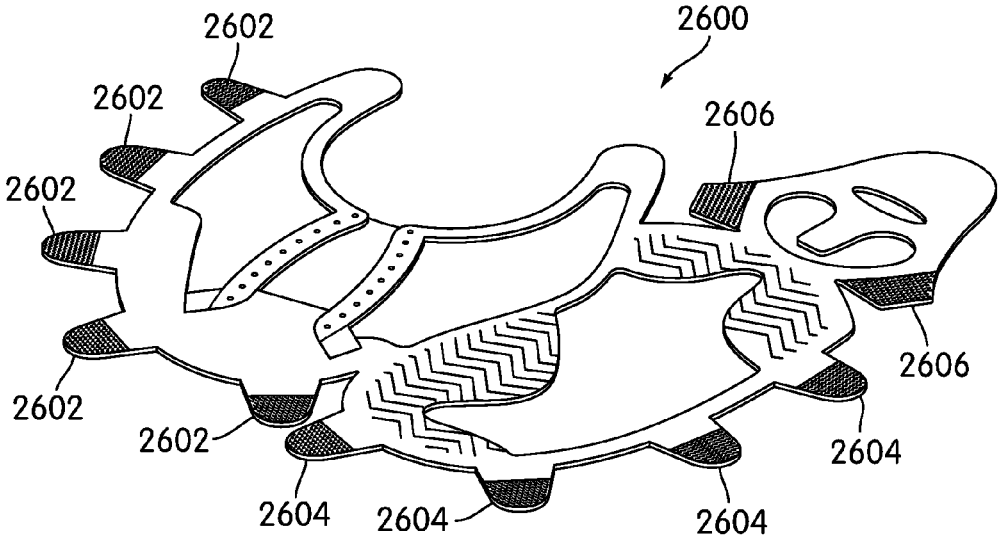
FIG. 26 is an isometric view of an exemplary embodiment of an unassembled article of footwear with an integral upper and sole.

FIG. 26 illustrates an alternative exemplary embodiment of an article of footwear 2600 with an integral upper and sole. In this embodiment, article of footwear 2600 may be provided with interlocking fasteners. In this embodiment, the interlocking fasteners may include top lateral edge fasteners 2602, bottom lateral edge fasteners 2604 and heel portion fasteners 2606.

Figure 27:
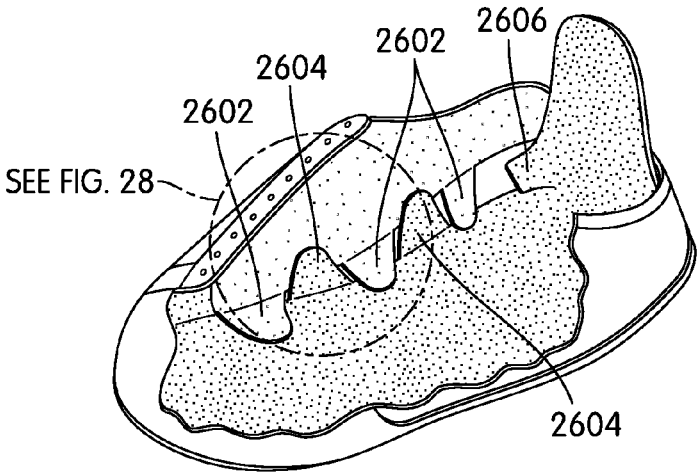
FIG. 27 is an isometric cut away view of an embodiment of interlocking fasteners on an article of footwear with an integral upper and sole.

FIG. 27 illustrates an exemplary embodiment of an article of footwear with interlocking fasteners. Referring to FIG. 27, top lateral edge fasteners 2602 may be alternatively interlaced with bottom lateral edge fasteners 2604 to form an interlocking seam. In this embodiment, top lateral edge fasteners 2602 engage with the inner material on the inside of the sole portion and bottom lateral edge fasteners 2604 engage with the inner material on the inside of the upper portion of the article of footwear. In some embodiments, heel portion fasteners 2606 engage with the inner material on the inside of the sole portion.

Figure 28:
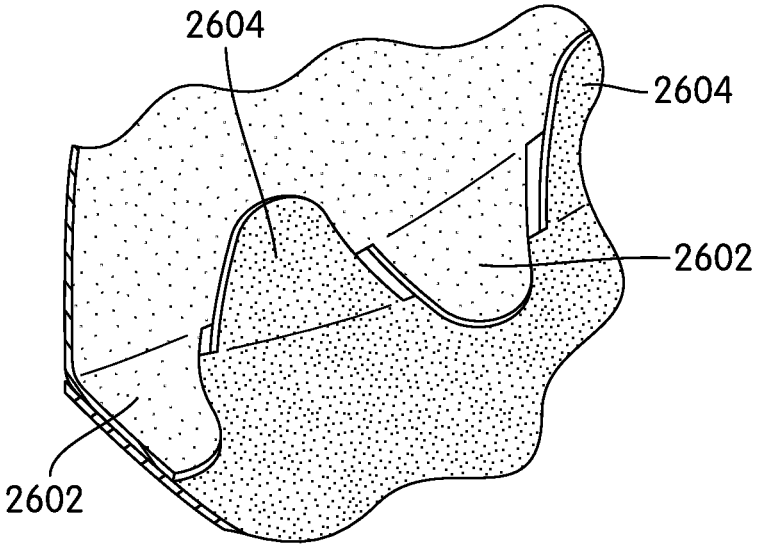
FIG. 28 is an isometric view of a close up of an embodiment of interlocking fasteners on an article of footwear with an integral upper and sole.

FIG. 28 illustrates a close up view of the interlocking fasteners engaging with the inner material of the article of footwear. In this embodiment, top lateral edge fasteners 2602 may engage with the inner material on the inside of the sole portion of the article of footwear. Bottom lateral edge fasteners 2604 may engage with the inner material on the inside of the upper portion of the article of footwear.

Figure 29:
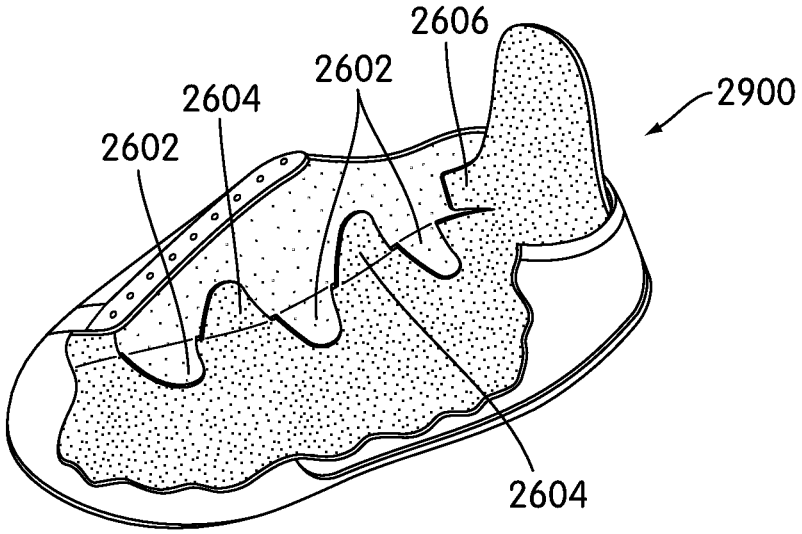
FIG. 29 is an isometric view of an embodiment of a partially attached lateral side of an article of footwear with an integral upper and sole.

FIG. 29 illustrates a cut away view of an exemplary embodiment of an article of footwear 2900 with an integral upper and sole that has been assembled using interlocking fasteners. In this embodiment, the interlocking fasteners form a releasable attachment for the top lateral edge and the bottom lateral edge to form the article of footwear 2900.

Figure 30:
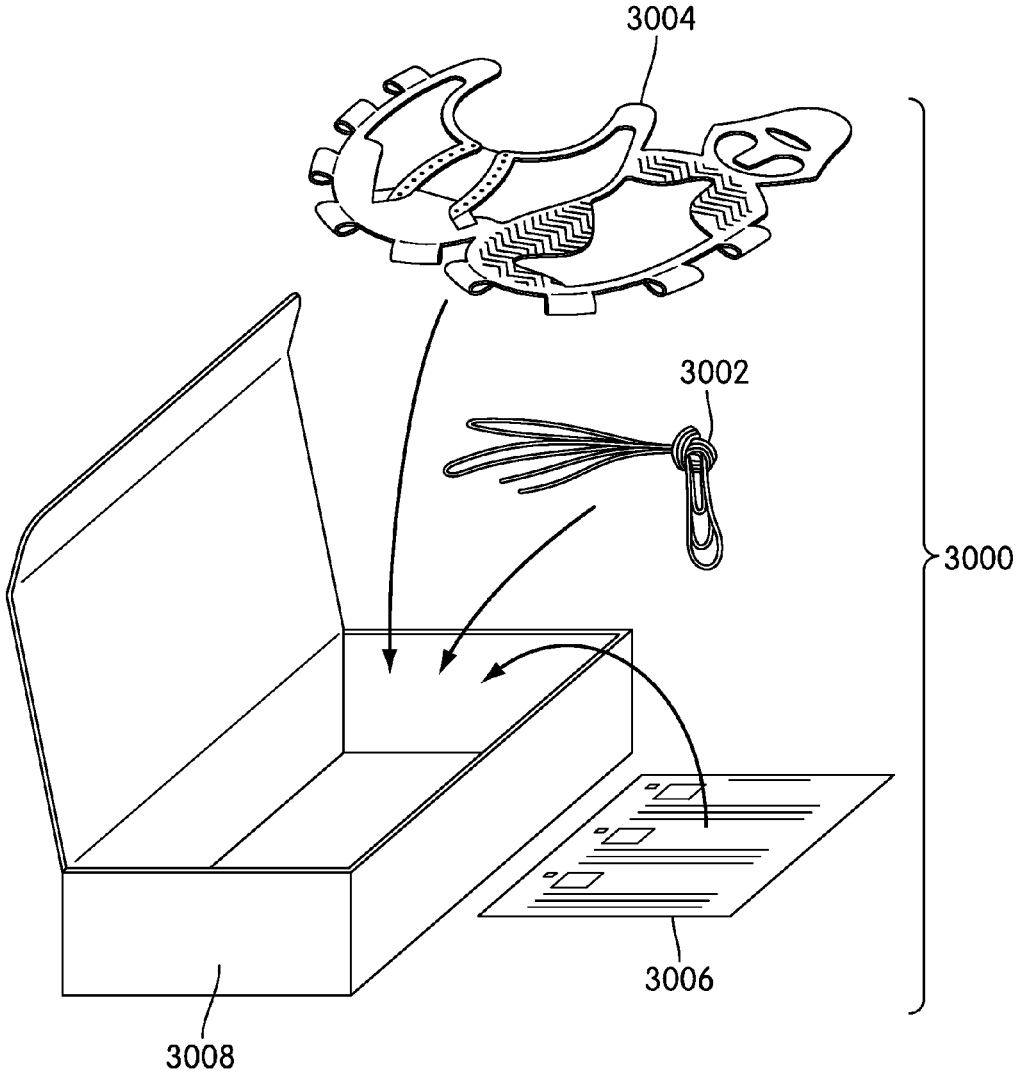
FIG. 30 is an isometric view of an exemplary embodiment of a kit of parts for self-assembly of an article of footwear with an integral upper and sole.

FIG. 30 illustrates an exemplary embodiment of a kit of parts 3000. In this embodiment, kit of parts 3000 may include an article of footwear 3004 with an integral upper and sole in an unassembled configuration. In some embodiments, kit of parts 3000 may include a cord 3002 for assembling article of footwear 3004. In one embodiment, article of footwear 3004 is provided with alternating channels for passage of cord 3002 as described in the exemplary embodiments discussed above.

In other embodiments, article of footwear 3004 may be provided with different mechanisms for assembly as described in the exemplary embodiments. Examples of the mechanisms for assembly of the article of footwear 3004 may include, but are not limited to, one or more of: stitching, interlocking fasteners, alternating channels, and pre-configured holes.

Kit of parts 3000 may include a set of instructions 3006. In some embodiments, set of instructions 3006 may include a list of directions for assembling article of footwear 3004. In some cases, set of instructions 3006 may include step by step directions. In other cases, set of instructions 3006 may include diagrams as well.

In some embodiments, the components comprising kit of parts 3000 may be gathered together for a customer. In some embodiments, the components comprising kit of parts 3000 may be packaged together so a customer can carry kit of parts 3000 home. In some cases, article of footwear 3004, cord 3002 and set of instructions 3006 may be packaged into container 3008. In other embodiments, the components comprising kit of parts 3000 could be packaged in a retail bag. Using this arrangement, a customer may easily carry home kit of parts 3000 or receive kit of parts 3000 in the mail.

For illustrative purposes, only the components needed to assemble a single article of footwear are shown in the present embodiments. However, it should be understood that a second article of footwear with an integral upper and sole as well as a second cord can be provided in a kit of parts to allow for the assembly of a pair of footwear, rather than just a single article of footwear.

Figure 31:
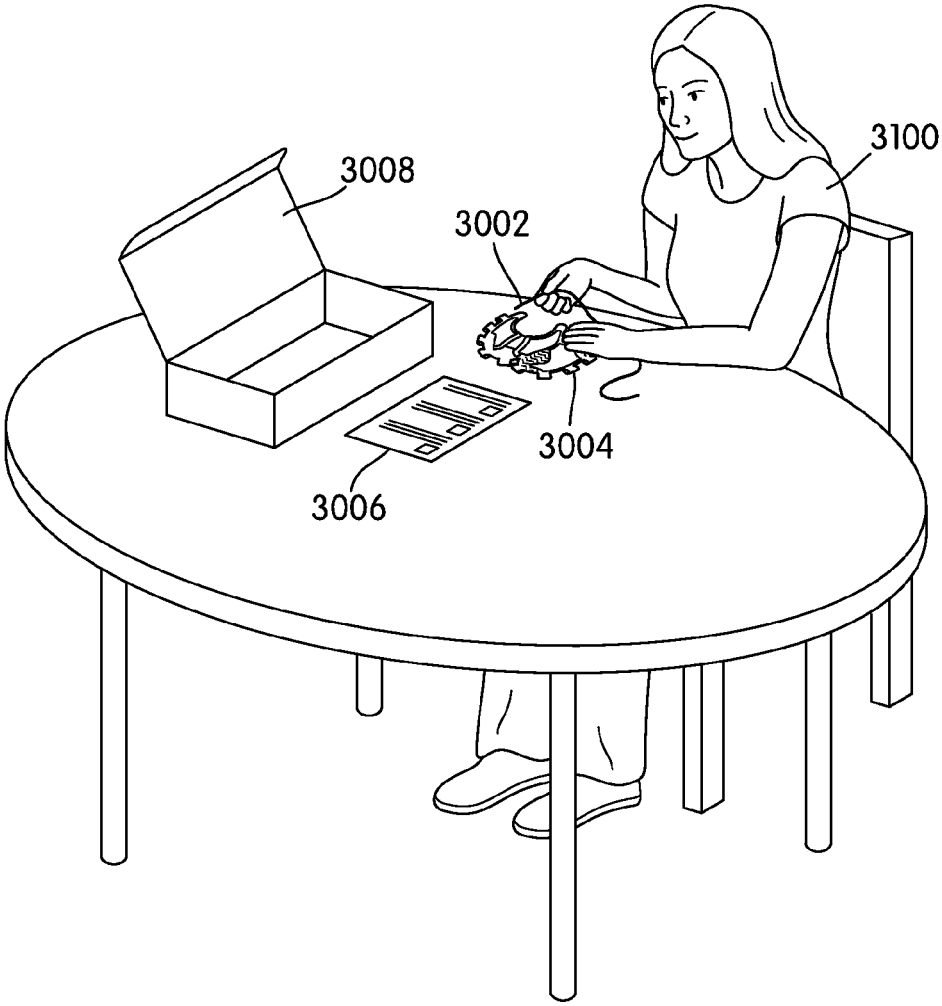
FIG. 31 is an isometric view of an exemplary embodiment of a customer assembling an article of footwear with an integral upper and sole.

FIG. 31 is an exemplary embodiment of customer 3100 assembling an article of footwear 3004 using cord 3002. In this embodiment, customer 3100 has removed unassembled article of footwear 3004, cord 3002 and set of instructions 3006 from container 3008. Using set of instructions 3006, customer 3100 may assemble article of footwear 3004 together using cord 3002.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A method of assembling an article of footwear comprising an integral upper portion and sole portion, the method comprising:

the article of footwear in an unassembled and flat condition, the unassembled article of footwear comprising:

an interior layer and an exterior layer connected to the interior layer;

the interior layer and the exterior layer being cut in a pattern forming an integral upper portion and sole portion;

the exterior layer comprising an outer material and a structural overlay disposed over the outer material, and the structural overlay being cut in the same pattern as the interior layer;

the structural overlay having a first opening that exposes a first portion of the outer material;

folding the article of footwear along a midline between the upper portion and the sole portion; and attaching a top lateral edge of the upper portion to a bottom lateral edge of the sole portion, wherein the first portion of the outer material is visible through the first opening of the structural overlay, and wherein the sole portion of the structural overlay includes an exposed ground engaging design.

2. The method of assembling an article of footwear according to claim 1, further comprising:

folding a heel portion to an upright position; and attaching the heel portion to the sole portion of the article of footwear.

3. The method of assembling an article of footwear according to claim 1, wherein the article of footwear comprises eyelets, and the first opening is larger than the eyelets.

4. The method of assembling an article of footwear according to claim 1, the structural overlay havinq a second opening that exposes a second portion of the outer material, wherein the second portion of the outer material is visible through the second opening of the structural overlay.

5. The method of assembling an article of footwear according to claim 4, wherein the exposed first portion has a first design and the exposed second portion has a second design, the first design and the second design being the same.

6. The method of assembling an article of footwear according to claim 4, wherein the exposed first portion has a first design and the exposed second portion has a second design, the first design and the second design being different.

7. The method of assembling an article of footwear according to claim 1, wherein the structural overlay comprises at least a first material and a second material, wherein the first material and second material have different levels of durability.

8. The method of assembling an article of footwear according to claim 1, wherein the interior layer comprises an inner material and the method further comprises the step of customizing at least one of the outer material and the inner material.

9. The method of assembling an article of footwear according to claim 1, wherein the step of attaching the top lateral edge of the upper portion to the bottom lateral edge of the sole portion further includes at least one of:

stitching;

lacing a thread through pre-configured holes;

passing a cord through alternating channels; and engaging interlocking fasteners.

10. The method of assembling an article of footwear according to claim 1, wherein the exposed first portion is in the upper portion and the exposed second portion is in the sole portion.

11. The method of assembling an article of footwear according to claim 1, wherein the outer material is cut in the same pattern as the interior layer.

12. A method of assembling an article of footwear comprising an integral upper portion and sole portion, the method comprising:

the article of footwear in an unassembled and flat condition, the unassembled article of footwear comprising:

an interior layer and an exterior layer connected to the interior layer;

the interior layer and the exterior layer being cut in a pattern forming an integral upper portion and sole portion;

the exterior layer comprising an outer material and a structural overlay disposed over the outer material, the structural overlay being cut in the same pattern as the interior layer;

the structural overlay having a first opening that exposes a first portion of the outer material in the upper portion and a second opening that exposes a second portion of the outer material in the sole portion;

folding the article of footwear along a midline between the upper portion and the sole portion; and attaching a top lateral edge of the upper portion to a bottom lateral edge of the sole portion, wherein the first portion of the outer material is visible through the first opening of the structural overlay, and the second portion of the outer material is visible through the second opening of the structural overlay.

13. The method of assembling an article of footwear according to claim 12, wherein the sole portion of the structural overlay includes an exposed ground engaging design.

14. The method of assembling an article of footwear according to claim 12, wherein the exposed first portion has a first design and the exposed second portion has a second design, the first design and the second design being the same.

15. The method of assembling an article of footwear according to claim 12, wherein the exposed first portion has a first design and the exposed second portion has a second design, the first design and the second design being different.

16. The method of assembling an article of footwear according to claim 12, wherein the outer material is cut in the same pattern as the interior layer.

* * * * *